US005565852A

United States Patent [19]

Peltier et al.

[11] Patent Number: 5,565,852

[45] Date of Patent: Oct. 15, 1996

[54] SMOKE DETECTOR WITH DIGITAL DISPLAY

[75] Inventors: Mark A. Peltier, Sherwood, Oreg.; Douglas H. Marman, Ridgefield, Wash.; David S. Terrett, Hickory; Michael E. Fossey, Charlotte, both of N.C.

[73] Assignee: Sentrol, Inc., Tualatin, Oreg.

[21] Appl. No.: 274,922

[22] Filed: Jul. 13, 1994

Related U.S. Application Data

[63] Continuation-in-part of Ser. No. 982,899, Nov. 30, 1992, abandoned.

[51] Int. Cl.[6] ..... G08B 19/00

[52] U.S. Cl. ..... 340/632; 340/506; 340/517; 340/521; 340/628; 340/825.36; 364/550

[58] Field of Search ..... 340/505, 506, 340/517, 521, 524, 628, 632, 825.36, 825.37, 825.54; 364/550

[56] References Cited

U.S. PATENT DOCUMENTS

| | | | |
|---|---|---|---|
| 3,767,917 | 10/1973 | Lampart et al. | 250/83.6 FT |
| 4,231,249 | 11/1980 | Zuckerman | 73/23 |
| 4,623,878 | 11/1986 | Schoenwetter | 340/628 |
| 4,673,920 | 6/1987 | Ferguson et al. | 340/521 |
| 4,744,038 | 5/1988 | Okayama | 340/628 |
| 4,924,417 | 5/1990 | Yuasa | 364/550 |
| 5,189,394 | 2/1993 | Walter et al. | 340/525 |
| 5,227,776 | 7/1993 | Starefoss | 340/628 |

FOREIGN PATENT DOCUMENTS

| | | |
|---|---|---|
| 2129179 | 5/1984 | United Kingdom . |
| 2149547 | 6/1985 | United Kingdom . |
| 2173932 | 10/1986 | United Kingdom . |
| 9214223 | 8/1992 | WIPO . |

*Primary Examiner*—Jeffery Hofsass
*Assistant Examiner*—Edward Lefkowitz
*Attorney, Agent, or Firm*—Stoel Rives LLP

[57] ABSTRACT

An improved environmental alarm system has centralized control of local sensor display capabilities displays, on the sensor itself, a variety of sensor data including sensor address, and detected levels of one or more environmental conditions. Alphanumeric characters are displayed at individual sensors in response to commands from a master microprocessor directing local sensor display content and timing. A local microcontroller within each sensor interprets the detected signal and prepares a resulting data signal that is available for downloading into the alphanumeric display in compliance with a coded message from the master microprocessor.

22 Claims, 3 Drawing Sheets

SMOKE DETECTOR WITH DIGITAL DISPLAY

This patent application is a continuation-in-part of application Ser. No. 07/982,899, filed Nov. 30, 1992, abandoned.

TECHNICAL FIELD

The present invention relates to environmental alarm detector systems having data display capability at remote sensing stations and, in particular, to an environmental alarm system having centralized control of remote displays.

BACKGROUND OF THE INVENTION

Environmental alarm systems such as fire, smoke, and passive infrared systems, for example, generally comprise a central controller ("control panel") connected by wires or radio frequency transmission to multiple sensing stations ("sensors") placed in strategic remote locations. In some "passive" systems the control panel simply gives an indication that something is wrong. In other "addressable" systems more specific information can be obtained by periodically polling the remote sensors.

Environmental sensors such as fire, smoke, and infrared detectors usually produce analog voltage or current output signals. The amount or density of detected smoke, the temperature sensed by a heat sensor, or sensor performance degradation can be conveyed by variations in the voltage or current of the output signal. When a system is addressable, the address of each sensor is a coded analog signal. This allows a message from a sensor to include information about a monitored environmental condition along with the location of a source of smoke, an unauthorized entry into a space, or other detected alarm-producing conditions, for example. The identification signal is usually a pattern of current pulses compliant with a protocol established by the design of the alarm system. An example of a communication protocol for environmental alarm systems is described in co-pending application Ser. No. 08/204,473, filed Mar. 1, 1994, and assigned to the assignee of the present application.

Remote sensors require periodic maintenance to maintain reliability. When servicing remote sensors, field maintenance personnel must be able to verify sensor functionality, sensitivity, and diagnostic signals. Certain prior physical security alarm system sensors have incorporated a simple visual signal, such as a single light-emitting diode, to indicate information such as whether the sensor is operating, whether there is an alarm condition, or whether a battery power supply has sufficient voltage for continued operation of the sensor.

In the past, sensor address identification signals could be verified, however, only by conducting a test of the system through the control panel. Such tests also required correlation of identification signals with sensor location. Prior techniques have used a portable digital voltmeter, temporarily connected to a sensor to obtain a digital display of analog signal output information such as condition information and address identification signals. However, such testing is inconvenient and may be hazardous depending upon the location of the sensor.

What is needed, therefore, is an improved environmental alarm system having centralized control of local information display. For example, information such as sensing element sensitivity, currently programmed address coding, an indication that an alarm condition is being sensed, the existence of a fault or degradation of performance in the sensing device, the need for sensor cleaning, an indication of the actual value being sensed, and indications of whether the sensing device is being interrogated by the central control panel should be visible on the sensor assembly itself.

SUMMARY OF THE INVENTION

The object of the present invention is, therefore, to provide an improved alarm system having centralized control of local sensor display. The present invention provides an improved alarm system by providing an environmental alarm system having centralized control of local sensor display capabilities for visibly displaying, on the sensor itself, a variety of sensor data including sensor address and detected levels of one or more environmental conditions.

In a preferred embodiment of the invention, an alarm system managed with an addressable sensor communication protocol includes a variety of sensors including smoke detectors, heat sensors, and passive infrared sensors. The sensors each have an alphanumeric digital display. Alphanumeric characters are displayed at individual sensors in response to commands from a master microprocessor directing local sensor display content and timing.

In each sensor, a detection element generates a signal representative of a detected parameter. A local microcontroller within each sensor interprets the detected signal and prepares a resulting data signal that is available for downloading into the alphanumeric display in compliance with a coded message from the master microprocessor.

Central microprocessor control prevents a number of problems that would otherwise be associated with simultaneous display of data at numerous sensors on the same system. Communication between the central control panel and numerous satellite sensors is preferably implemented in accordance with one of a variety of pulse generation techniques. A common method for such communication uses a combination of voltage and current pulsing for communication and sensor control. Sensor interrogation is conducted with voltage pulses while sensor response is articulated in electrical current pulses. Therefore, master microprocessor control of multiple microcontroller-managed individual sensors prevents coincident display illumination in multiple sensors that could cause a system-wide current drop mimicking a protocol signal requiring servicing by either the central microprocessor or any of the several individual microcontrollers. Central display control also allows local display timing to coincide with maintenance personnel schedules. Therefore, in the present invention, the local microcontroller and consequently, the display, are under the control of the master microprocessor.

In the system of the present invention, the sensor alphanumeric display may sequentially indicate a variety of information such as the sensor address and a digitally encoded display message corresponding to the level of a detected parameter. The sensor display message may also indicate sensor type and status. Normal conditions, alarm conditions, sensor malfunction, or a need for sensor maintenance may be displayed. A calibration table containing thresholds used to determine when alarm conditions are encountered or detector cleaning is needed is stored in an EEPROM or other nonvolatile memory device located in the central control panel. If the sensor signal exceeds the threshold, an alarm indication or other signal indicative of a performance parameter is available for display at the direction of the central control panel.

DETAILED DESCRIPTION OF PREFERRED EMBODIMENTS

Figure 1:
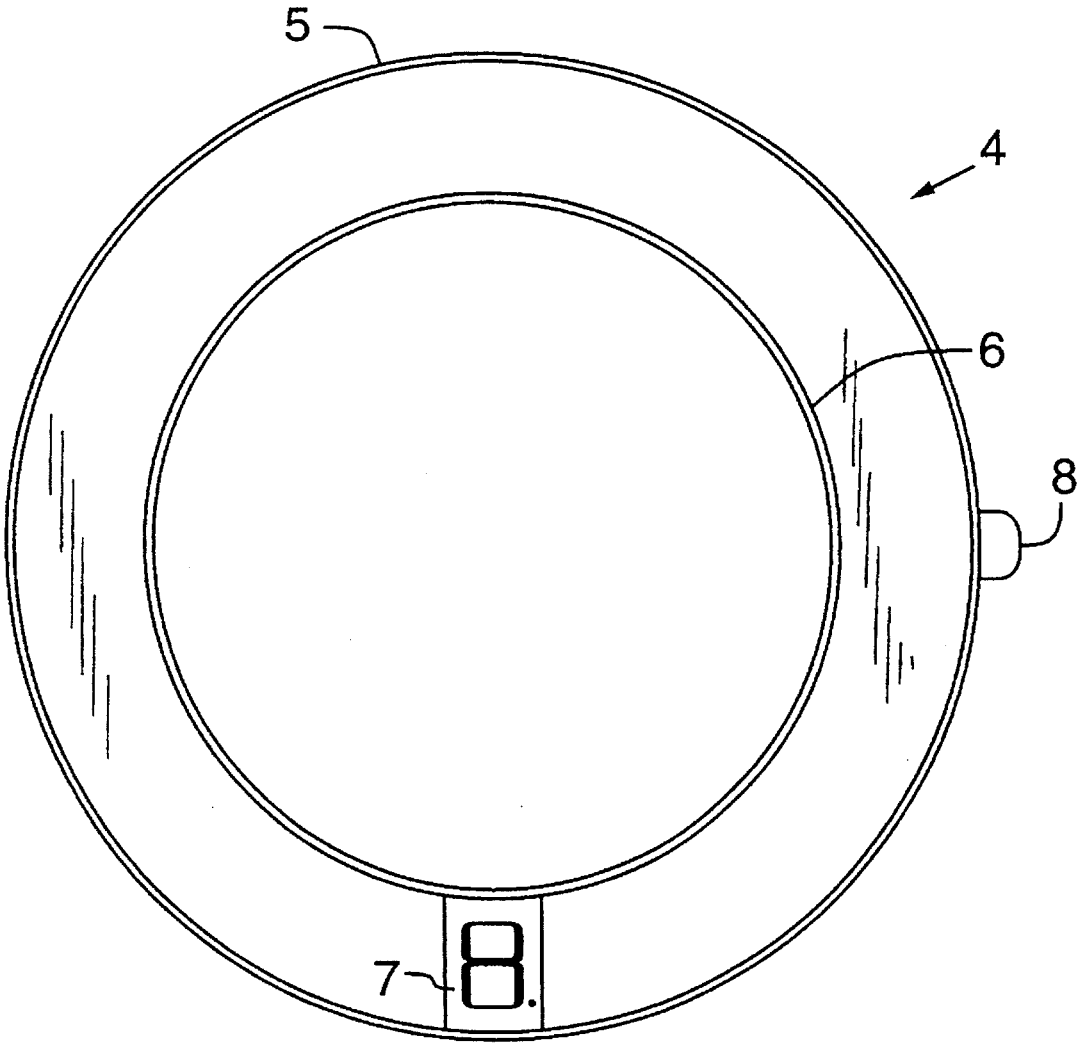
FIG. 1 is a pictorial view an individual smoke detection sensor employed in the present invention.

As shown in FIG. 1, a sensor 4 includes a housing 5 that has a front cover plate 6 through which an alphanumeric visual display 7 is visible. Display 7 may use any of a variety of display technologies such as seven-segment light-emitting diode ("LED"), gas discharge tube, or liquid crystal display ("LCD"), for example. Display 7 is a seven-segment LED display in a preferred embodiment of the present invention. A manual reed switch 8 may optionally be included to manually activate display 7. Sensor unit 4 may be of any conventional type that monitors environmental conditions. The embodiment shown in FIG. 1 is an optical smoke detector which may be mounted on a wall or ceiling.

Figure 2:
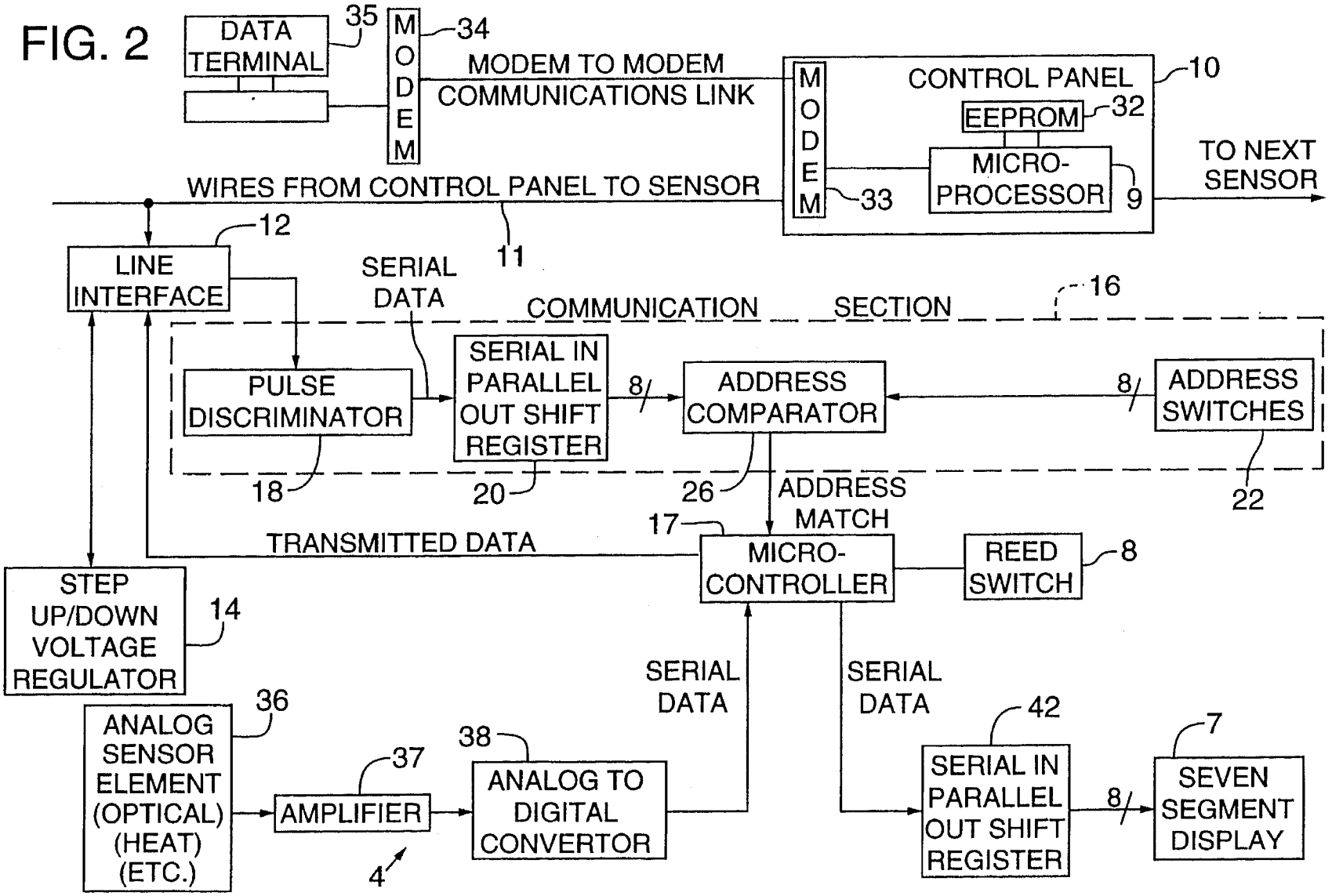
FIG. 2 is a block schematic diagram depicting circuit elements of a smoke detection sensor interconnected to a central control panel in accordance with the present invention.

A block schematic diagram of sensor 4 providing a local alphanumeric display under centralized control is shown in FIG. 2. Sensor 4 is capable of sequentially displaying address and detected parameter data in decimal, binary, or alphanumeric format. Sensor 4 is controlled by commands from a master microprocessor 9 located in a centralized control panel 10. Microprocessor 9 may be any microprocessor or an array of multiple microprocessors suited to control applications. Examples of such microprocessors are the Intel 80186 and the Motorola 68020.

To allow individual control of specific sensors, commands from master microprocessor 9 are preferably articulated with a message structure prefaced with an address coding unique to the targeted sensor. However, systems having few sensors may be controlled with message structures lacking unique addressing structures.

Sensor 4 is connected to control panel 10 by a wire link 11. However, sensor unit 4 and control panel 10 may communicate by hard-wired interconnection or radio frequency communication.

In the preferred embodiment shown, wire link 11 is a two-wire line that conveys both electrical power and data between sensor 4 and control panel 10. Communication is articulated by pulse code modulation so that sensor 4 may be monitored or "supervised" periodically by control panel 10.

Wire link 11 is coupled to sensor 4 through a line interface circuit 12 that contains protective devices to protect sensor 4 from lightning, electromagnetic interference, and polarity reversal. In a battery-powered sensor, line interface 12 is not required. Battery-powered sensors may be used in systems using radio frequency communication between sensors and control panel 10.

Line interface 12 is connected to a voltage regulator 14 which supplies the various voltages for the powered components of sensor 4. Communications data from line interface 12 are directed to a communication section 16. In a passive security system, communication section 16 is not required. However in active systems under the direction of control panel 10, some technique for address and message discrimination is needed. That function may be performed either by a local microcontroller 17 found in sensor 4, or in a separate preconditioning circuit such as communication section 16. Communication section 16 includes a pulse discriminator 18 that resolves incoming pulses into logic levels that represent the bit pattern received from microprocessor 9. Serial address and message data from the output of pulse discriminator 18 are then loaded into a serial-in/parallel-out shift register 20.

Sensor unit 4 contains a set of address switches 22 which may be located in any convenient place on the sensor unit. Address switches 22 are set to provide the unique local address or ID code for sensor 4. The code from address switches 22 is provided to an address comparator 26. The output of serial-in/parallel-out shift register 20 is also connected to address comparator 26. Address comparator 26 compares the command address resolved by pulse discriminator 18 with the resident address of the sensor unit; and if there is a match, the command message is passed to microcontroller 17.

In a preferred embodiment, microcontroller 17 is an eight-bit microcontroller such as a Motorola MC68HC05J1 or an Intel 80C31; however, any microprocessor may be used as microcontroller 17. Data representing signaling or detector alarm thresholds are stored in an EEPROM 32 located in control panel 10. These data are provided for comparative purposes because in some modes of operation, the display can indicate whether the sensor is operating inside or outside of a tolerance range of certain parameters. For example, smoke detector units may require periodic cleaning. A certain percentage of the signal passing from a light-emitting diode to a photodetector may, over time, become obscured by dust. Microcontroller 17 could be programmed to determine whether the analog data indicating the amount of light incident upon the photodetector was above or below a threshold standard obtained from data stored in EEPROM 32. Microcontroller 17 may, in such circumstances, be programmed to indicate through display 7 that the sensor unit should be cleaned.

Data may optionally be loaded into EEPROM 32 through a modem-to-modem communications link shown in FIG. 2 connecting modem 33 and a second modem 34. Second modem 34 is tied to a programming source such as a data terminal 35. Data from EEPROM 32 are conveyed to microcontroller 17 by wire link 11 under a handshake protocol between microcontroller 17 and master microprocessor 9.

Sensor 4 detects variations in environmental conditions such as heat or smoke-obstructed light by interpreting voltage signals from an analog sensor element 36. When environmental conditions vary, the output voltage of element 36 varies. Those variations are interpreted by microcontroller 17 according to data and messages conveyed to sensor 4 from microprocessor 9 in control panel 10. Sensor element 36 may be a photodetector, an ion detector, or a heat detector as well as any other type of conventional physical condition element which provides an analog output signal. The signal from element 36 is amplified by an amplifier 37 connected to an analog-to-digital converter 38. Serial data from analog-to-digital converter 38 are provided to microcontroller 17.

Sensor 4 includes a seven-segment LED display 7 that features a single digit made up of seven LED segments and a decimal point. Display 7 may be located in any convenient location on the sensor unit. Input data for display 7 is in eight-bit parallel format. Consequently, serial data from microcontroller 17 is converted to parallel format by a serial-in/parallel-out shift register 42, which provides the parallel byte structure to seven-segment display 7 under local control of microcontroller 17 as directed by microprocessor 9. Microcontroller 17 also transmits alarm data to line interface circuit 12 and hence to control panel 10 over wire link 11.

Microprocessor 9 may direct microcontroller 17 to perform one of several discrete tasks such as, for example, polling the last output from sensor element 36 or enabling display 7. Microprocessor 9 directs the content or timing of individual display 7 by controlling microcontroller 17. Microprocessor 9 and microcontroller 17 preferably communicate through a standardized protocol such as that disclosed in the aforementioned co-pending application No. 08/204,473.

Incoming information from microprocessor 9 is processed by addressing communication section 16 depicted in FIG. 2. Message structures from microprocessor 9 are preferably introduced by a frame pulse followed by an address coding. If the address coding of a message structure matches the local resident sensor address, the message packet from microprocessor 9 is conveyed to microcontroller 17. The message packet may contain a code directive from which microcontroller 17 initiates one of several routines to service the receptive and display elements of sensor 4.

When microcontroller 17 is powered up, polling mode is enabled and continues until microcontroller 17 is directed by microprocessor 9 to perform another service routine. During polling mode, microcontroller 17 periodically polls the output of analog-to-digital converter 38 to read analog data from analog sensor element 36. These data are compared with serial data obtained from EEPROM 32, and if comparison between the two indicates an alarm condition, an alarm message is loaded into an output register of microcontroller 17 for transmission to microprocessor 9 through line interface 12 when microprocessor 9 performs an alarm poll of the sensor address.

Similarly, by conveying the appropriate message packet to microcontroller 17 through communication section 16, master microprocessor 9 may direct microcontroller 17 to enable display 7. In an alternative embodiment of the invention, the display mode may be locally initiated by manually closing a magnetic reed switch 8 which may be located in any user-accessible location on the sensor.

Figure 3:
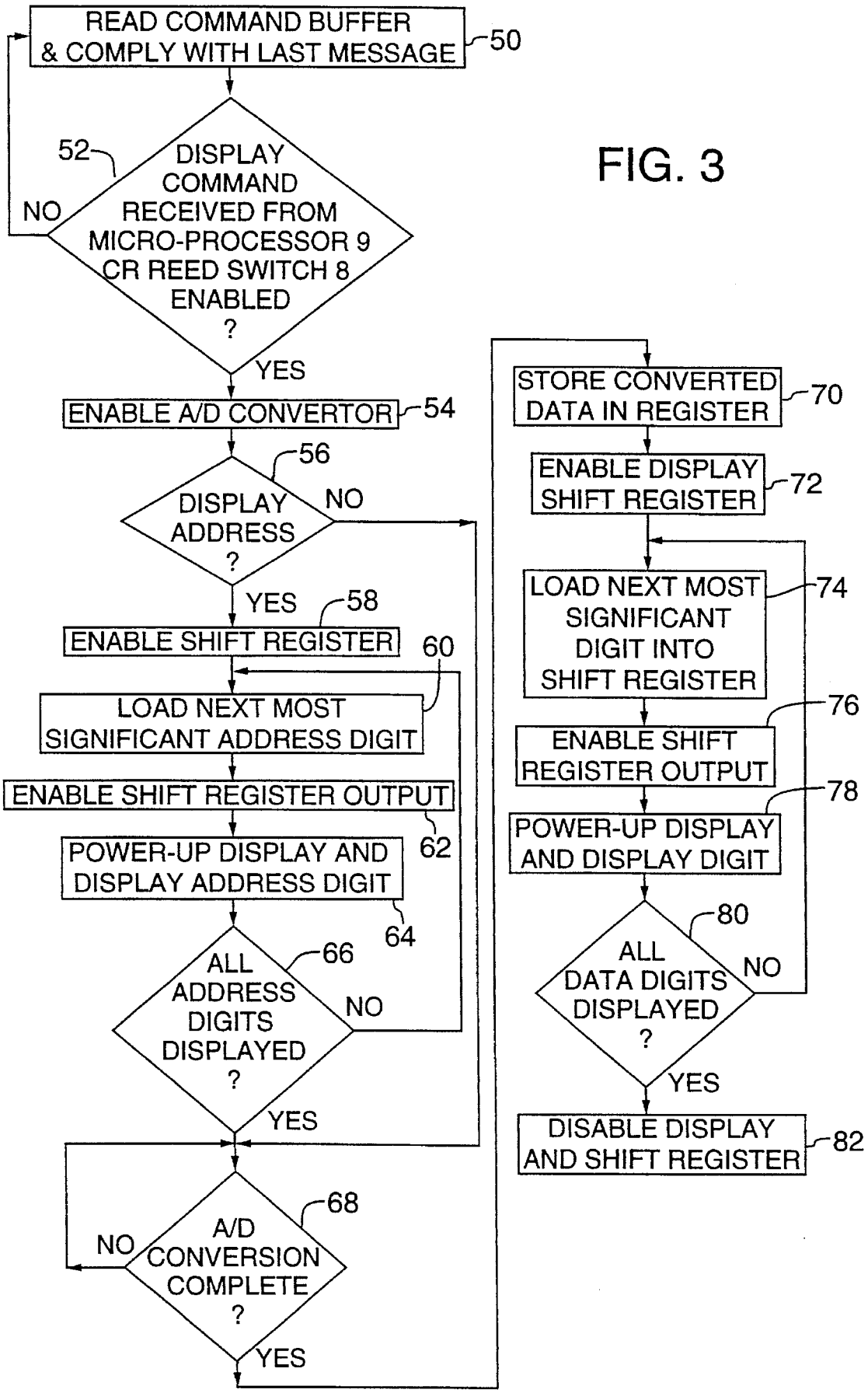
FIG. 3 is a diagram depicting the program flow executed by the microcontroller in the smoke detection sensor schematic diagram shown in FIG. 2.

FIG. 3 illustrates the servicing routine of microcontroller 17 after receiving a display command from microprocessor 9 or reed switch 8 is enabled. As depicted in process block 50, microcontroller 17 periodically polls a command buffer containing the last received message packet from microprocessor 9. Decision block 52 indicates that microcontroller 17 evaluates commands received from microprocessor 9 to determine whether a display command has been received or reed switch 8 has been enabled. If microprocessor 9 has directed microcontroller 17 to enable display 7 or reed switch 8 has been activated, analog to digital converter 38 is enabled as indicated in process block 54. Once analog to digital converter 38 has been activated, decision block 56 indicates that microcontroller 17 determines whether the message from master microprocessor 9 has directed that the address be displayed prior to data display. If so, the microcontroller 17 will enable shift register 42 and load the most significant address digit as shown in process blocks 58 and 60. The output of shift register 42 will then be enabled as shown in process block 62, and the parallel output of shift register 42 will be downloaded into enabled display 7 as depicted in process block 64. If the displayed digit does not conclude the address, the next most significant address digit is loaded into shift register 42 and displayed on display 7 as indicated by the program flow line from decision block 66 to process block 60. This cycle continues until all address digits have been displayed.

Typically, the address consists of two or three digits. The user will see each digit displayed in sequence with a brief pause between digits. After all address digits have been displayed, or the original message command from master microprocessor 9 directed that only parameter data be displayed, decision block 68 indicates that microcontroller 17 interrogates analog to digital converter 38 to determine whether the data from analog sensor element 36 have been converted into digital format. If not, the program flow loops until analog to digital conversion has been completed.

Once analog to digital conversion is complete, microcontroller 17 stores the converted digital data in an internal register as shown in process block 70. The most significant digit of the converted analog data is loaded into enabled shift register 42 as depicted in process blocks 72 and 74. Microcontroller 17 directs shift register 42 to download the converted data to powered-up display 7 to display the data digit as shown in process blocks 76 and 78. As decision block 80 indicates, after a data digit has been displayed, microcontroller 17 determines whether all data digits have been displayed. If not, execution flow returns to process block 74 and follows through the program flow until decision block 80 yields an affirmative answer. Once all data digits have been displayed sequentially, microcontroller 17 disables display unit 7 and shift register 42, as shown in process block 82.

The preferred embodiment of the invention implements a system for displaying either the address of the sensor followed by an alphanumeric representation of a detected level of an environmental parameter or the detected parameter level without the sensor address. It will be appreciated, however, that other types of information may be displayed. For example, an "F" may be displayed to indicate a fault occurring in the sensor, a "C" could be displayed to indicate the need for cleaning, an "E" could signal an error condition, and a flashing or constant "A" could signal the existence of an alarm condition. In addition, a character could be displayed representing relative sensitivity of the sensor. In each case, sensor data are compared with data representing a threshold condition stored in EEPROM 32. When the sensor data exceed the threshold, microcontroller 17 causes display 7 to display the alphanumeric character complaint with the request of master microprocessor 9.

In another application, the display could be used to calibrate or align the sensor when used as a receptor in a two-part infrared beam system. Such systems have an infrared beam transmitter that projects an infrared beam at a receptive sensor located across the span of a monitored space. When the beam is broken by an obstruction such as an intruder or undesired smoke, an alarm is signaled. Such systems are, however, difficult to align, and the seven-segment display of the invention could be used to provide alignment information during initial set-up.

It will be obvious to those having skill in the art that many changes may be made in the above-described details of the preferred embodiment of the present invention without departing from the underlying principles thereof. The scope of the present invention should, therefore, be determined only by the following claims.

We claim:

1. An environmental alarm system, comprising:

a master controller located in a controller area for selectively directing operational functions of the alarm system, the master controller issuing commands in association with sensor identification addresses for delivery to a data communication link;

a sensor having a sensor identification address and sensing a physical property in an area apart from the controller area, the sensor including a slave microprocessor that is operatively connected to the data communication, the slave microprocessor receiving through the data communication link a command issued by the master controller and associated with the sensor identification address of the sensor and transmitting through the data communication link to the master controller data relating to the sensed physical property in response to the command and the sensor identification address to verify the association of the sensor and the data; and an alphanumeric display mounted proximal to the sensor and controlled by the slave microprocessor, the display capable of selectively displaying multiple messages in accordance with corresponding commands directed by the master controller to the sensor.

2. The system of claim 1 wherein communication between the master controller and slave microprocessor is articulated in a protocol structured to include a sensor identification address message segment representing the sensor identification address for the sensor.

3. The system of claim 2 wherein the protocol is structured to include a data display message segment instructing the slave microprocessor to enable the display to indicate a representation of the sensed physical property.

4. The system of claim 2 wherein the protocol is structured to include a sensor identification address display message segment instructing the slave microprocessor to enable the display to indicate a representation of the sensor identification address.

5. The system of claim 2 wherein the protocol is structured to include a dual display message segment instructing the slave microprocessor to enable the display to sequentially indicate the sensed physical property and the sensor identification address.

6. The system of claim 1 wherein the display indicates a representation of the sensed physical property.

7. The system of claim 1 wherein the sensor includes a manually operable switch that enables the display to indicate a representation of the sensed physical property.

8. The system of claim 1 wherein the master controller includes a master microprocessor and controller storage sites for threshold data.

9. The system of claim 8 wherein the controller storage sites for threshold data are operatively connectable to a modem for programming from an external source.

10. The system of claim 1 wherein the display includes a single alphanumeric character.

11. The system of claim 1 wherein the master controller communicates with a plurality of sensors.

12. An environmental alarm system, comprising:

a master controller located in a controller area for selectively directing operational functions of the alarm system, the master controller issuing commands in association with sensor identification addresses for delivery to a data communication link and having controller storage sites for storing information associated with the sensor identification addresses;

a sensor for sensing a physical property in an area distinct from the controller area, the sensor having a sensor identification address and including interpretative circuitry that is operatively connected to the data communication link to receive and act Upon a command issued by the master controller and to receive information stored in the controller storage sites, the command and information being associated with the sensor identification address of the sensor; and an alphanumeric display capable of selectively displaying multiple messages and mounted proximal to the sensor for indicating a set of indicia representing information relating to the sensed physical property and received from the controller storage sites in accordance with the command issued by the master controller.

13. The system of claim 12 wherein communication between the master controller and sensor is articulated in a protocol structured to include a sensor identification address message segment representing the sensor identification address for the sensor.

14. The system of claim 13 wherein the master controller communicates with a plurality of sensors.

15. The system of claim 14 wherein the protocol is structured to include a data display message segment instructing the interpretative circuitry of the sensor to enable the display to indicate the set of indicia.

16. The system of claim 14 wherein the set of indicia constitutes a first set and the protocol is structured to include a sensor identification address display message segment instructing the interpretative circuitry of the sensor to enable display of a second set of indicia representing the sensor identification address of the sensor.

17. The system of claim 16 wherein the protocol is structured to include a dual display message segment instructing the interpretative circuitry of the sensor to enable the display to sequentially indicate the first and second sets of indicia.

18. The system of claim 14 wherein the master controller includes a master microprocessor and the controller storage sites store threshold data.

19. The system of claim 18 wherein the interpretative circuitry obtains threshold data from the controller storage sites through the master microprocessor.

20. The system of claim 18 wherein the threshold data are written to the controller storage sites through a modem linked to an external data source.

21. The system of claim 12 wherein the sensor includes a manually operable switch that enables the alphanumeric display to indicate the set of indicia.

22. The system of claim 12 wherein the display includes a single alphanumeric character.

* * * * *